US006864636B1

(12) United States Patent
Hagmann

(10) Patent No.: US 6,864,636 B1
(45) Date of Patent: Mar. 8, 2005

(54) APPARATUS, METHOD, AND SYSTEM FOR A LASER-ASSISTED FIELD EMISSION MICROWAVE SIGNAL GENERATOR

(76) Inventor: Mark J. Hagmann, 762 Lacey Way, North Salt Lake, UT (US) 84054

( * ) Notice: Subject to any disclaimer, the term of this patent is extended or adjusted under 35 U.S.C. 154(b) by 32 days.

(21) Appl. No.: 10/625,380

(22) Filed: Jul. 23, 2003

Related U.S. Application Data

(60) Provisional application No. 60/399,096, filed on Jul. 25, 2002.

(51) Int. Cl.[7] ..... H01J 7/24

(52) U.S. Cl. ..... 315/111.21; 315/111.71

(58) Field of Search ..... 315/111.21, 111.31, 315/111.61, 111.71; 372/55

(56) References Cited

U.S. PATENT DOCUMENTS

| | | | | |
|---|---|---|---|---|
| 3,958,189 | A | 5/1976 | Sprangle et al. | 331/94.5 PE |
| 4,888,776 | A | 12/1989 | Dolezal et al. | 372/2 |
| 4,912,367 | A | 3/1990 | Schumacher et al. | 315/3.5 |
| 6,100,640 | A | 8/2000 | Cathey et al. | 315/169.3 |
| 6,204,606 | B1 | 3/2001 | Spence et al. | 315/111.21 |
| 6,339,297 | B1 * | 1/2002 | Sugai et al. | 315/111.21 |
| 6,538,388 | B2 * | 3/2003 | Nakano et al. | 315/111.21 |

OTHER PUBLICATIONS

Peter H. Siegel, Fellow, IEEE "Terahertz Technology", IEEE Transactions on Microwave Theory and Techniques, vol. 50, No. 3 Mar. 2002; p. 910–928.

E.R. Brown, F. W. Smith and K.A. McIntosh "Coherent Millimeter–wave Generation by Heterodyne Conversion in Low–temperature–grown GaAs Photoconductors", J. Appl. Phys. 73 (3), Feb. 1, 1993; p. 1480–1463.

Mark J. Hagmann "Stable and Efficient Numerical Method for Solving the Schrodinger Equation to Determine the Response of Tunneling Electrons to a Laser Pulse", International Journal of Quantum Chemistry, vol. 70, p. 703–710 (1998) No. 4/5.

L. Arnold and W. Krieger, H. Walter "Laser–frequency mising using the scanning tunneling microscope", J. Vac Sci. Technol. A 6 (2), Mar./Apr. 1988; p. 466–469.

Mark J. Hagmann "Simulations of photon–assisted field emission: their significance in basic science and device applications", Ultramicroscopy 79 (1999); p. 115–124.

Mark J. Hagmann "Simulations of the generation of broadband signals from DC to 100 THz by photomizing in laser–assisted field emission", Ultramicroscopy 73 (1998); p. 89–97.

S.K. Masalmeh, H.K.E. Stadermann, J. Korving "Mixing and rectification properties of MIM diodes", Physica B 218 (1996); p. 56–59.

Mark J. Hagmann "Stimulations of Laser–Assisted field Emission Within the Local Density Approximation of Kohn-Sham Density–Functional Theory", International Journal of Quantum Chemistry, vol. 65, No. 5, p. 857–865 (1997).

Mark J. Hagmann "Single–Photon and Multiphoton Processes Causing Resonance in the Transmission of Electrons by a Single Potential Barrier in a Radiation Field", International Journal of Quantum Chemistry, vol. 75 No. 4/5, p. 417–427 (1999).

(List continued on next page.)

*Primary Examiner*—David Vu
(74) *Attorney, Agent, or Firm*—Kunzler & Associates

(57) ABSTRACT

A source electrode is biased to lower the potential barrier of surface electrons. A laser radiates the source electrode, producing a tunneling electron current. The tunneling electron current oscillates in response to frequency of the laser. The impedance match circuit couples the current from a high-impedance source electrode of a laser-assisted field emission to a lower-impedance connector, creating a high-frequency microwave signal source. Two or more lasers may be photomixed to further tune the frequency of the microwave signal.

36 Claims, 7 Drawing Sheets

OTHER PUBLICATIONS

Mark J. Hagmann "Mechanism for Resonance in the Interaction of Tunneling Particles with Modulation Quanta", J. Appl. Phys. 78 (1), Jul. 1, 1995; p. 25–29.
Alexandre Mayer and Jean–Pol Vigneron "Quantum–Mechanical Simulations of Photon–stimulated field emission by Transfer Matrices and Green's functions", Physical Review B, vol. 62, No. 15 Dec. 2000–1; p. 16 138–16 145.
Mayer, N. M. Miskovsky, and P.H. Cutler "Photon–stimulated field Emission from Semiconducting (10, 0) and Metallic (5, 5) carbon Nanotubes", Physical Review B, vol. 65, 195416; p. 195416–1—195416–6.
A. Mayer, N. M. Miskovsky and P.H. Cutler "Three–dimensional Simulations of Field Emission through an Oscillating Barrier from a (10,0) Carbon Nanotube", J. Vac. Sci. Technol. B 21(1), Jan./Feb. 2003; p. 395–399.
Georg Goubau "Surface Waves and Their Application to Transmission Lines", Journal of Applied Physics, vol. 21 Nov. 1950; p. 1119–1128.
Karen N. Kocharyan, Mohammed Nurul Afsar, and Igor I. Tkachov "Millimeter–Wave Magnetooptics: New Method for characterization of Ferrites in the Millimeter–Wave Range", IEEE Transactions on Microwave theory and tech., vol. 47, No. 12 Dec. 1999; p. 2636–2643.
W. Zhu, C. Bower and O. Zhou, and G. Kochanski and S Jin "Large Current Density from Carbon Nanotue Field Emitters", Applied Physics Letters, vol. 75, No. 6, Aug. 9, 1999; p. 873–875.
R. Tarkiainen, M. Ahlskog, J. Penttila, L. Roschier, P. Hakonen, M. Paalanen, and E. Sonin "Multiwalled Carbon Nanotube: Luttinger Versus Fermi Liguid", Physical Review B, vol. 64, 195412, p. 195412–1—195412–4.
Markus Ahlskog, Pertti Hakonen, Mikko Paalanen, Leif Roschier, and Reeta Tarkiainen "Multiwalled Carbon Nanotubes as Building Blocks in Nanoelectronics", Journal of Low Temperature Physics, vol. 124, Nos. 1 /2, 2001; p. 335–352.
A. Bachtold, M. de Jonge, K. Grove–Rasmussen, and P.L. McEuen "Suppression of Tunneling into Multiwall Carbon Nanotubes", Physical Review Letters, vol. 87, No. 16 Oct. 15, 2001; p. 166801–1—166801–4.
P.J. Burke "An RF Circuit Model for Carbon Nanotubes", IEEE Transactions on Nanotechnology, vol. 2, No. 1 Mar. 2003; p. 55–58.
D. B. Rutledge, S. E. Schwarz and A. T. Adams "Infrared and Submillimetre Antennas", Infrared Physics Dec. 18, 1978; p. 713–729.

* cited by examiner

APPARATUS, METHOD, AND SYSTEM FOR A LASER-ASSISTED FIELD EMISSION MICROWAVE SIGNAL GENERATOR

CROSS-REFERENCES TO RELATED APPLICATIONS

This application is a continuation-in-part of and claims priority to U.S. Provisional Patent Application No. 60/399,096 entitled "LASER-ASSISTED FIELD EMISSION MICROWAVE SIGNAL GENERATOR" and filed on Jul. 25, 2002 for Mark Hagmann, which is incorporated herein by reference.

BACKGROUND OF THE INVENTION

1. Field of the Invention

This invention relates to microwave signal generation and more particularly relates to laser-assisted field emission generation of a microwave signal.

2. Description of the Related Art

The increasing performance demands of high-speed communications require the generation of electromagnetic signals at ever-higher microwave frequencies. Yet the physical constraints of materials and electromagnetic radiation have limited the frequencies of microwave signals. The output power of both vacuum tube- and semiconductor-based signal generators fall off sharply at frequencies above 1 terahertz.

The operating frequencies of electronic devices have been increased by taking advantage of the higher switching speeds of optoelectronic devices. The Auston Switch uses pulsed lasers to modulate the conductivity of a photoconductive substrate such as Gallium Arsenide (GaAs). The laser pulse excites electrons from a valence band to a conduction band, changing the substrate from an insulator to a conductor. Auston Switches have switching times of about 500 fs, allowing them to generate extremely narrow electrical pulses or high-frequency signals.

Lasers have also been used to modulate the current in field emission devices. In field emission, an applied electric field reduces the potential barrier at the surface of a metal or semiconductor. When the potential barrier is reduced to be near the Fermi level of the electrons, the electrons "tunnel" from the metal or semiconductor. The tunneling electrons create an electric current. The tunneling electron current can be modulated by laser radiation. The response time of tunneling electron current to a laser pulse can be as brief as 2 fs, less than one percent of the response time of the photoconductive substrate in an Auston Switch, making laser-modulated field emission-based devices ideal for microwave signal generation.

A laser-assisted field emission signal generator must drive a load with a typical input impedance of about 50 Ω. Yet the impedance of the field emission device is much higher. Unless the high impedance of the field emission device is matched with the low impedance of the load, a laser-assisted field emission signal generator cannot produce a useful signal.

What is needed is a process, apparatus, and system that generates a microwave signal using a laser-assisted field emission device. Beneficially, such a process, apparatus, and system would generate a high-frequency, tunable microwave signal. The process, apparatus, and system would further couple the high impedance of the field emission to a lower output impedance.

BRIEF SUMMARY OF THE INVENTION

The present invention has been developed in response to the present state of the art, and in particular, in response to the problems and needs in the art that have not yet been fully solved by currently available laser-assisted microwave signal generators. Accordingly, the present invention has been developed to provide a process, apparatus, and system for generating microwave signals that overcome many or all of the above-discussed shortcomings in the art.

A device of the present invention is presented for generating microwave signals using a laser-assisted field emission. The device is provided with an evacuated chamber, a source electrode, a collector electrode, a laser, an impedance match circuit, and a connector. The source electrode is negatively biased, reducing the potential barrier of the source electrode. The laser radiates the source electrode, further lowering the potential barrier of the source electrode and allowing electrons to tunnel from the surface of the source electrode as a tunneling electron current.

The impedance match circuit couples the tunneling electron current of the source electron to the connector, altering the high impedance of the source electrode to the target impedance of the connector.

The apparatus, in one embodiment, is configured with a coaxial tapered impedance match circuit. The tapering of the coaxial conductor alters the impedance of source electrode to match the target impedance of the connector. In an alternate embodiment, the apparatus may be configured with coplanar transmission line strips to match the impedance of the source electrode with the connector.

In a further embodiment, the apparatus is configured with coplanar transmission lines. The transmission lines are separated by a conducting stripline. The transmission lines are negatively biased with respect to the conducting stripline.

An impedance match circuit of the present invention is also presented for a laser-assisted field emission signal generator. The impedance match circuit couples the tunneling electron current of the high-impedance source electrode to a lower-impedance connector.

In one embodiment, the impedance match circuit is configured as a tapered coaxial transmission line. In an alternate embodiment, the impedance match circuit is configured as coplanar transmission lines.

The present invention enables the tunneling electron current of a laser-assisted field emission device to be coupled through a connector. The invention further provides a device for generating laser-tunable microwave signals. These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
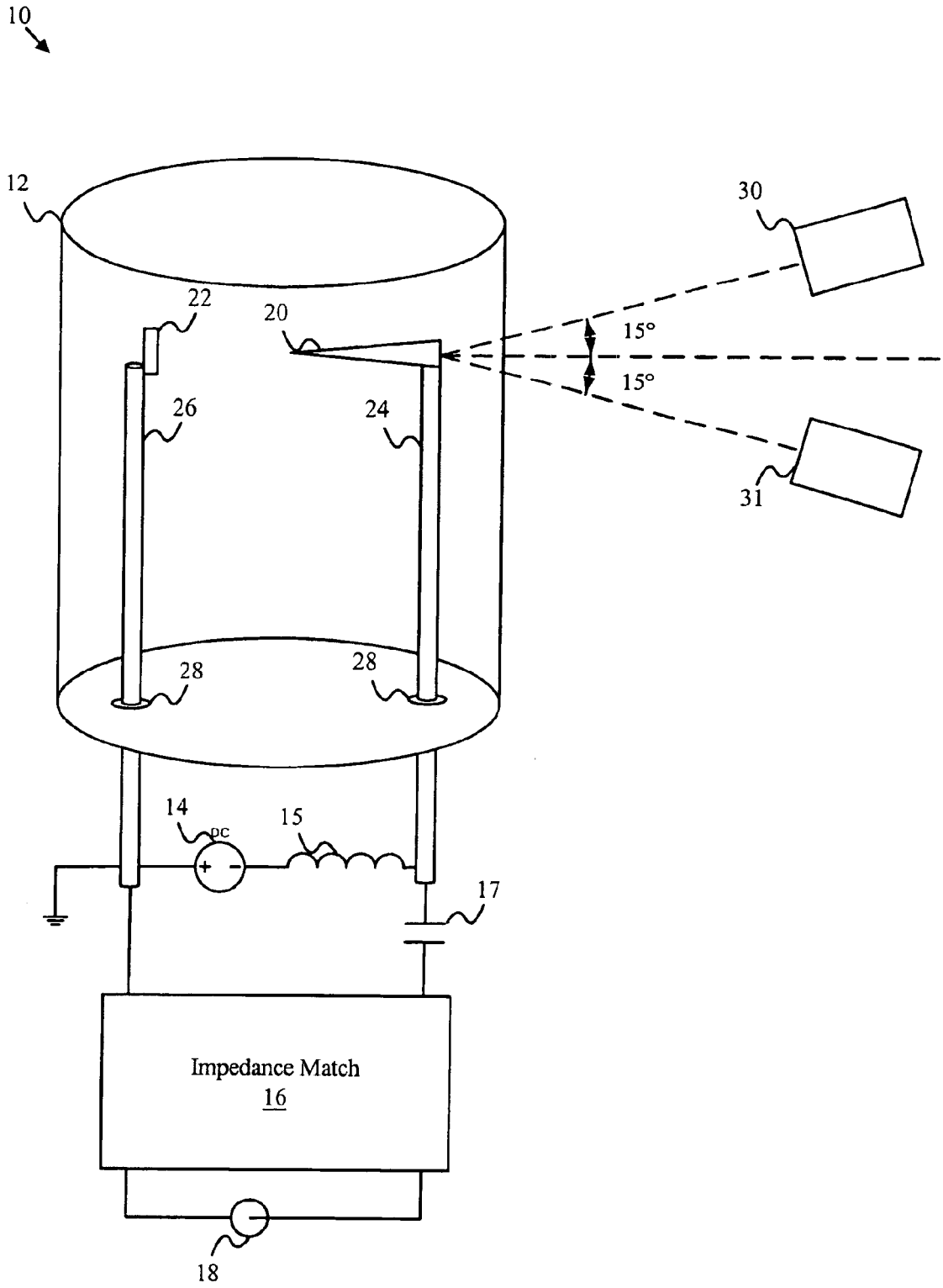
FIG. 1 is a diagram of a laser-assisted field emission microwave signal generator.

When electromagnetic energy from a source such as a laser irradiates an electron-emitting tip that is DC biased at a high negative potential in vacuum, electrons are emitted from the tip by a process that is called laser-assisted field emission. In some applications, more than one laser may be used to irradiate the electron-emitting tip to cause laser-assisted field emission. The relationship of the current of the emitted electrons to the magnitude of the electric field of the radiation, which may be modeled as shown below, has a characteristic that is similar to the relationship of the current to the applied potential difference in a mixer diode.

The non-linear dependence of the field emission current on the magnitude of the total electric field at the electron-emitting tip may be represented by an expanded Taylor series as shown in the following equation:

$$I(E_0+\Delta E) = I(E_0) + \left.\frac{\partial I}{\partial E}\right|_{E_0}\cdot\Delta E + \left.\frac{\partial^2 I}{\partial E^2}\right|_{E_0}\cdot\frac{(\Delta E)^2}{2} + \ldots \qquad \text{Equation 1}$$

Thus, for a specific value of $E_0$, with $|\Delta E| << |E_0|$, Equation 2 applies.

$$I = I_0 + A\cdot\Delta E + B\cdot(\Delta E)^2 \qquad \text{Equation 2}$$

Wherein, $E_0$ is the magnitude of the applied static field, and $\Delta E$ is the magnitude of the electric field vector of the radiation. For the case that the radiation is produced by two lasers having different frequencies, wherein, $E_1$ and $E_2$ represent the magnitude of the electric field, and $\omega_1$ and $\omega_2$ represent the angular frequency of the radiation from the first and second lasers, respectively.

$$\Delta E = E_1 \text{ COS } (\omega_1 t) + E_2 \text{ COS } (\omega_2 t) \qquad \text{Equation 3}$$

Substituting Equation 3 into Equation 2 gives the following result:

$$\begin{aligned} I = I_0 &+ \frac{B}{2}(E_1^2+E_2^2) + AE_1\cos(\omega_1 t) + \\ &AE_2\cos(\omega_2 t) + \frac{BE_1^2}{2}\cos(2\omega_1 t) + \frac{BE_2^2}{2}\cos(2\omega_2 t) + \\ &BE_1E_2\cos[(\omega_1+\omega_2)t] + BE_1E_2\cos[(\omega_1-\omega_2)t] \end{aligned} \qquad \text{Equation 4}$$

If the response of the circuit that is connected to the electron-emitting tip and the anode is limited to frequencies less than $\omega_1$ and $\omega_2$ then Equation 4 may be simplified to give the following expression for the total current:

$$I = I_0 + \frac{B}{2}(E_1^2+E_2^2) + BE_1E_2\cos[(\omega_1-\omega_2)t] \qquad \text{Equation 5}$$

The characteristics of the field emission current that are shown in Equations 1–5 indicate that laser-assisted field emission has many applications. In one application, the radiation from a single laser may be switched on and off at switching times as short as a few femptoseconds using known optical techniques. The single laser may be used to gate the field emission current because, as shown in Equation 5, the current is proportional to the square of the magnitude of the electric field of the radiation (e.g., $E_1$). Switching the first laser switches the electric field of the radiation from the first laser between 0 and $E_1$, thereby gating the field emission current. Note, however, that because a single laser is used, the third term of Equation 5 is zero so no difference-frequency signal is generated when only one laser is used.

In another application, the amplitude of the radiation (e.g., $E_1$) from a single laser may be amplitude modulated to modulate the field emission current. Referring again to Equation 5, the field emission current is proportional to the square of the magnitude of the electric field of the radiation (e.g., $E_1$), which in this case is amplitude modulated between a minimum value of 0 and a maximum value of $E_1$. Accordingly, amplitude modulation of the radiation causes amplitude modulation of the field emission current.

In a third application, two lasers that generate radiation in which the magnitudes of the electric field are $E_1$ and $E_2$ and the frequencies are $\omega_1$ and $\omega_2$, respectively, may be used to perform optical mixing, wherein the frequency of the output signal is equal to the difference between the two optical frequencies (e.g., $\omega_1$ and $\omega_2$), as shown in Equation 5. Additionally, in a similar configuration, laser-assisted field emission may be used as a heterodyne receiver that receives radiation from a transmitter and downconverts this radiation to an intermediate radio frequency by using a local optical field.

Experimentation and simulations have revealed a quantum resonance in the interaction of tunneling electrons with electromagnetic radiation. This resonant interaction causes the effect of a laser on the emitted current to be approximately 30 dB greater than the effect of time-dependent fields at much lower frequencies. The mechanism for this resonance is reinforcement of the quantum wave function by reflections at the classical turning points for electrons in the potential barrier. Thus, for the case of a square potential barrier, the resonance occurs when an electron is promoted above the potential barrier by absorbing one quantum from the radiation field such that the length of the barrier is an integral multiple of one-half of the DeBroglie wavelength. In laser-assisted field emission the wavelength of the radiation for resonance depends on the applied static field and the material used for the electron-emitting tip. For example, with a tungsten electron-emitting tip at room temperature the resonance occurs at a wavelength of 500 nanometers (nm) with an applied field of 6 V/nm, and at a wavelength of 400 nm with an applied field of 5 V/nm.

By way of example, the laser-assisted field emission microwave signal generator of the present invention will be described as having a source electrode with a pointed electron-emitting tip, and an anode or collector electrode, both sealed within an evacuated chamber. A DC voltage source is connected between the electron-emitting tip and the collector to create a static field. In accordance with the present invention, the electron-emitting tip is irradiated with radiation from one or more sources such as lasers, which causes the electric vector of the radiation to be superimposed on the applied static field, thereby changing the height of the potential barrier that electrons must overcome to be emitted from the surface of the tip. Thus, the time-averaged probability of electron emission by quantum tunneling is increased and the instantaneous probability is made to oscillate. The radiation causes a rapid variation in the emitted current, to create a signal at the surface of the electron-emitting tip. The power of this signal at the electron-emitting tip is proportional to the square of the static current and the square of the power flux density of the radiation.

It is desirable to use the signal caused by the rapid variation in the emitted current in various applications such as microwave signal generators. The DC bias or static field, between the electron-emitting tip and the collector is typically hundreds or thousands of volts, which causes a current due to the field emission of electrons. For example, in one application, an electron-emitting tip is biased at 1,000 V with respect to a collector, which results in a field emission current of approximately 1 microampere ($\mu$A). The beam impedance of a field emission device is defined as the DC bias voltage divided by the field emission current that results from the DC bias. For the above-noted example, therefore, the beam impedance would be approximately 1,000,000,000 Ohms (Ω). Most equipment in the electronics industry has an impedance that is much lower than the beam impedance, a typical value being 50 Ω. Accordingly, an impedance matching device must be used to efficiently couple signals from a laser-assisted field emission system having a large beam impedance to electronics equipment having a much lower impedance such as 50 Ω. It is unusual to require impedance matching over such a large range of range of impedances.

Turning now to the figures, FIG. 1 is a diagram of a laser-assisted field emission microwave signal generator 10 that includes a field emission tube 12 that is connected to a DC bias voltage supply 14 through an RF choke 15. The RF choke 15 prevents high frequency signals from entering the DC bias voltage supply 14. The RF choke 15 may be an inductor or alternatively it may be an abrupt change in the impedance caused by changing the conductor width or diameter. The laser-assisted field emission microwave signal generator is connected to an impedance matching circuit 16 through a coupling capacitor 17, which prevents the voltage from the DC bias supply 14 from entering the impedance matching circuit 16, while at the same time providing a low impedance path for the high frequency signals. The coupling capacitor 17 connects the high frequency signals to a coaxial connector 18. The field emission tube 12 is an evacuated glass enclosure that contains an electron-emitting tip 20 and a collector 22, which are mounted on conductive leads 24 and 26, respectively. The conductive leads 24, 26 are brought outside the field emission tube 12 through glass-to-metal seals 28. In a preferred embodiment, the field emission tube 12 is fabricated from a glass that is suitable for ultrahigh vacuum, and has a diameter as small as possible (less than 2 centimeters). Furthermore, the conductive, leads 24, 26 should be as short as possible (less than 2 centimeters) and the conductive leads 24, 26 need not extend more than 2 millimeters outside of the field emission tube 12. Keeping the conductive leads 24, 26 short with respect to the wavelength of the signal minimizes the attenuation that is caused by radiation loss and reduces the change in the source impedance that is projected to the impedance matching circuit 16.

As previously noted, laser-assisted field emission may be carried out using one or more lasers. The following description contemplates the use of a single laser that is used to modulate or gate the field emission current. During operation of the laser-assisted field emission microwave signal generator 10, a laser 30, which is preferably disposed at a 15° angle with respect to the electron-emitting tip 20, as shown in FIG. 1, is used to irradiate the DC-biased electron-emitting tip 20 to gate the current by laser-assisted field emission. The diameter of the field emission tube 12 is preferably as small as possible to aid in the precise focusing of the laser 30 on the electron-emitting tip 20. A field emission current is created by the emission of electrons from the electron-emitting tip 20. The gated field emission current is coupled from the electron-emitting tip 20 to the impedance matching circuit 16, which matches the beam impedance to the load that is attached to the coaxial connector 18.

In applications such as photomixing, a second laser 31 may be provided locally. Alternatively, in applications such as heterodyne receiving, the second laser 31 may be at a transmitter that is located remotely from the laser-assisted field emission microwave signal generator 10. In either case, the interaction of the radiation from the first and second lasers 30, 31 at the electron-emitting tip creates a field emission current as represented in Equation 5. Accordingly, a signal at a frequency equal to the difference between the frequencies of the lasers ($\omega_1$ and $\omega_2$) is created at the electron-emitting tip.

Figure 2:
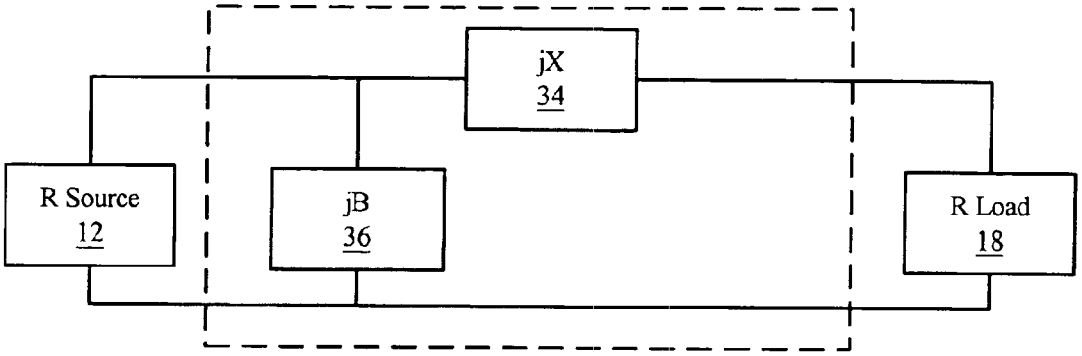
FIG. 2 is an equivalent circuit of a laser-assisted field emission microwave signal generator, including an L-section narrow-band impedance matching circuit.

FIG. 2 is an equivalent circuit of a laser-assisted field emission microwave signal generator including an L-section narrow-band impedance matching circuit 32. This impedance matching circuit 32 is one embodiment of the impedance matching circuit 16 that is shown in FIG. 1. The electron-emitting tip 20 and the collector 22 within the field emission tube 12 (FIG. 1) may be modeled as an ideal current source, having a source impedance ($R_{resource}$) equivalent to the beam impedance, and the load attached to the coaxial connector 18 (FIG. 1) may be modeled as $R_{load}$. The L-section narrow-band impedance matching circuit 32 includes two reactive components, jX 34 and jB 36, which represent series reactance and parallel susceptance, respectively. As will be appreciated by one skilled in the art, inductor and capacitor component values can be calculated directly once the reactance and susceptance have been calculated using Equations 6 and 7. Equations 6 and 7 may be simplified as shown because the reactance of the source and the load are negligible, and the value of $R_{source}$ is much greater than $R_{load}$.

$$X = \pm\sqrt{R_{load}(R_{source} - R_{load})} = \pm\sqrt{R_{load}R_{source}} \qquad \text{Equations 6 and 7}$$

$$B = \pm\frac{\sqrt{(R_{source} - R_{load})}}{R_{source}\sqrt{R_{load}}} = \pm\frac{1}{\sqrt{R_{load}R_{source}}}$$

Although the equivalent circuit shown in FIG. 2 will provide an impedance match between the source impedance of field emission tube 12 and the load attached; to the coaxial connector 18, this match is very narrow-band because the optimum values for the inductive and capacitive components selected for jX 34 and jB 36 vary greatly with the frequency of operation.

Figure 3:
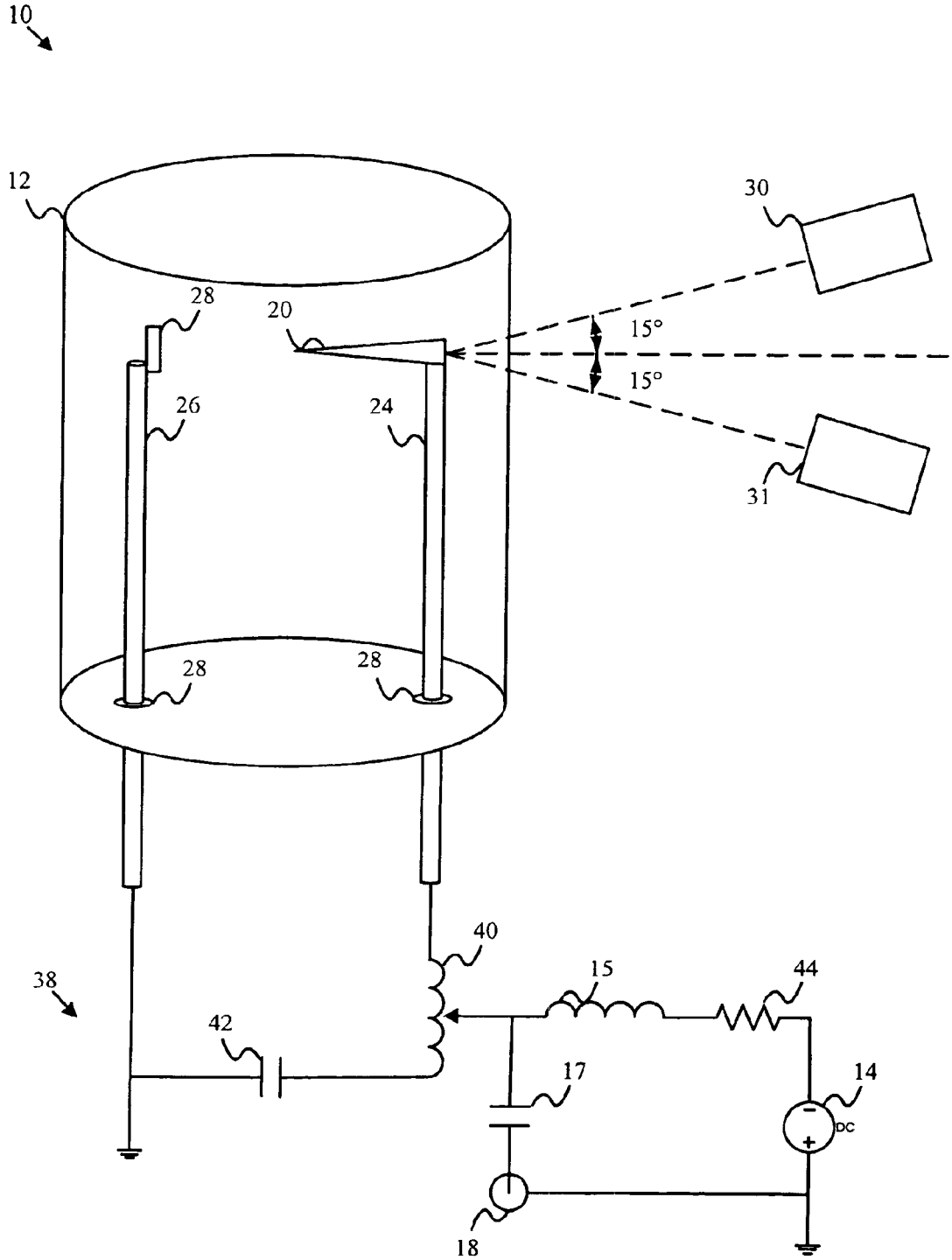
FIG. 3 is a diagram of a laser-assisted field emission microwave signal generator, including a wide-band impedance matching circuit using an autotransformer.

FIG. 3 is a diagram of a laser-assisted field emission microwave signal generator 10 using a wide-band impedance matching circuit 38. The wide-band impedance matching circuit 38 includes an autotransformer 40 that is connected to the conductive lead 24 and further connected to a DC blocking capacitor 42 that is connected to the conductive lead 26, which is grounded. Depending on the range of frequencies used, the autotransformer may or may not have a ferrite core. The wide-band impedance matching circuit 38 also includes a RF choke 15 that is connected between a ballast resistor 44 and the autotransformer 40. A DC bias voltage supply 14 is connected between the ballast resistor 44 and ground. A coupling capacitor 17 is used to isolate a coaxial connector 18 from the DC bias voltage supply 14 and to provide a low impedance path for high frequency signals from the autotransformer 40 to the coaxial connector 18.

In operation, the DC bias voltage supply 14 negatively biases the electron-emitting tip 20 through the ballast resistor 44, the autotransformer 40 and the RF choke 15. The laser 30 irradiates the electron-emitting tip 20, which modifies the emission of electrons. The emission of electrons creates a field emission current that flows from the electron-emitting tip 20 down the conductive lead 24 to the autotransformer 40. The coaxial connector 18 is coupled through the coupling capacitor 17 to the autotransformer 40, which matches the large beam impedance to the load that is attached to the coaxial connector 18.

Once again, a second laser 31 may be provided, either locally or remotely, to provide a second radiation field that interacts with the radiation from the first laser 30 to create a field emission current as modeled by Equation 5. Such interaction creates a signal at a frequency equal to the difference between the frequencies of the first and second sources of radiation.

Figure 4:
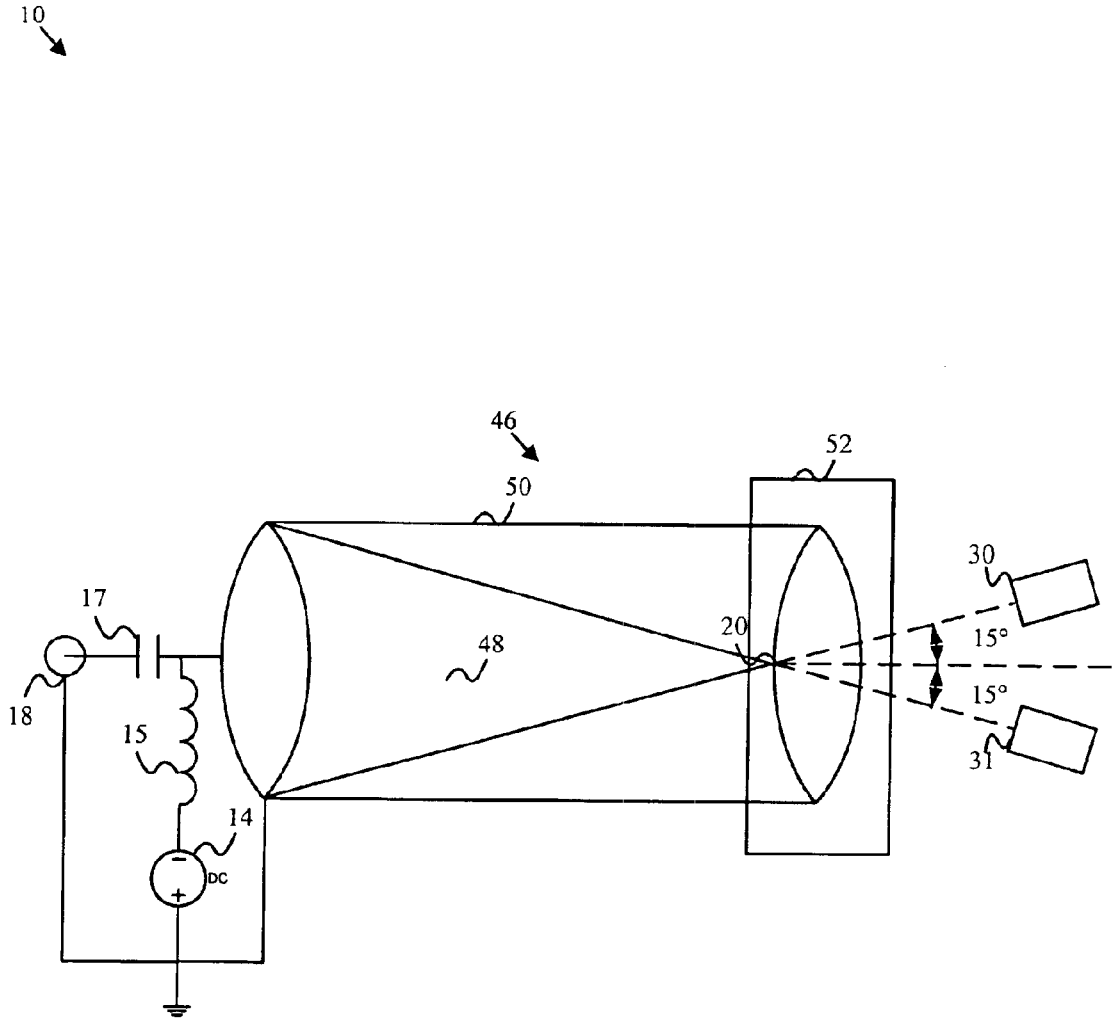
FIG. 4 is a diagram of a laser-assisted field emission microwave signal generator, including a coaxial tapered impedance matching circuit.

FIG. 4 is a diagram of a laser-assisted field emission microwave signal generator 10 using a coaxial tapered impedance matching circuit 46 that is fabricated from a coaxial line having a center conductor 48 and an outer conductor 50. A laser-assisted field emission microwave signal generator 10 having a coaxial tapered impedance matching circuit 46 is operable over a frequency range from DC to somewhat greater than 10 GHz. The center conductor 48 includes an electron-emitting tip 20 that emits electrons to the outer conductor 50 when the DC bias voltage supply 14 is applied to the center conductor 48 and the laser 30 irradiates the electron-emitting tip 20. In another embodiment, a second laser 31 may be used in applications such as photomixing or heterodyne receiving. Electron emission creates a current that propagates along the center conductor 48. The center conductor 48 is connected to a coupling capacitor 17 that provides a low impedance path to the coaxial connector 18.

Although the beam impedance at the electron-emitting tip 20 is large, the center conductor 48 is tapered to match the beam impedance to the impedance of the load that is attached to the coaxial connector 18. At least the electron-emitting tip 20 and part of the outer conductor 50 near the electron-emitting tip 20 must be enclosed in an evacuated field emission tube 52. In a preferred embodiment, the circumference of the outer conductor 50 is smaller than a wavelength of the signal to assure single mode operation and to limit radiation loss.

Figure 5:
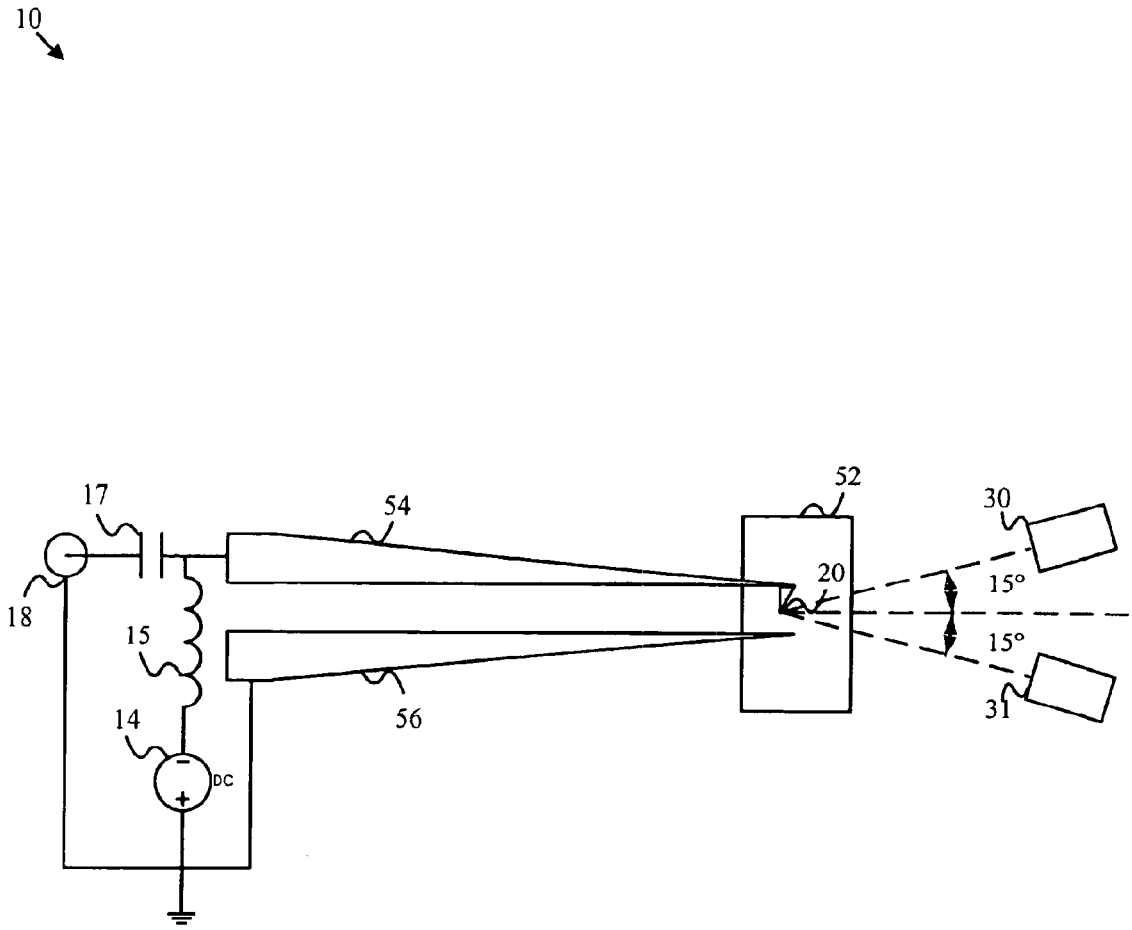
FIG. 5 is a diagram of a laser-assisted field emission microwave signal generator, including a coplanar stripline and a tapered impedance matching circuit.

FIG. 5 is a diagram of a laser-assisted field emission microwave signal generator 10 that includes a coplanar transmission line with conducting strips 54 and 56. The DC bias voltage source 14, through the RF choke 15, negatively biases conducting strip 54 with respect to conducting strip 56. An electron-emitting tip 20 is disposed at the end of strip 54 and a collector 22 is disposed at the end of strip 56. The electron-emitting tip 20 and the collector 22 are sealed within an evacuated field emission tube 58. Both of the conducting strips 54, 56 are tapered to form an impedance match between a load that is attached to the coaxial connector 18, and the beam impedance. As will be appreciated to those that are skilled in the art, as a conducting strip such as 54 or 56 is made wider, the capacitance O==, between the two strips increases and the inductance decreases, thereby resulting in a lower characteristic impedance. Accordingly, near the electron-emitting tip 26 both strips 54, 56 are narrow and have a high characteristic impedance to match the beam impedance. Portions of the conducting strips 54, 56 that are closer to the coaxial connector 18 are wider and, therefore, have lower impedance to match the load that is attached to the coaxial connector 18. Therefore, the tapered strips gradually increase in impedance from the portions near the coaxial connector 18 to the portions near the electron-emitting tip 20 to match the load that is attached to the coaxial connector, to the high beam impedance.

As the laser 30 irradiates the electron-emitting tip 20, a field emission current flows down conducting strip 54 through the coupling capacitor 17 toward the coaxial connector 18. As noted, a second laser 31 may be added for photomixing or heterodyne receiving applications. The conducting strips 54, 56 may be fabricated on a substrate and the laser 30 may be disposed above the plane of the substrate. The substrate may or may not have a ground plane on the opposite side from the conducting strips 54, 56. In another embodiment, the conducting strips 54, 56 may be fabricated without a substrate and may be supported using membrane technology. In a preferred embodiment, the conducting strips 54, 56 are spaced much closer than a wavelength of the signal to ensure single mode operation and to limit radiation loss.

Figure 6:
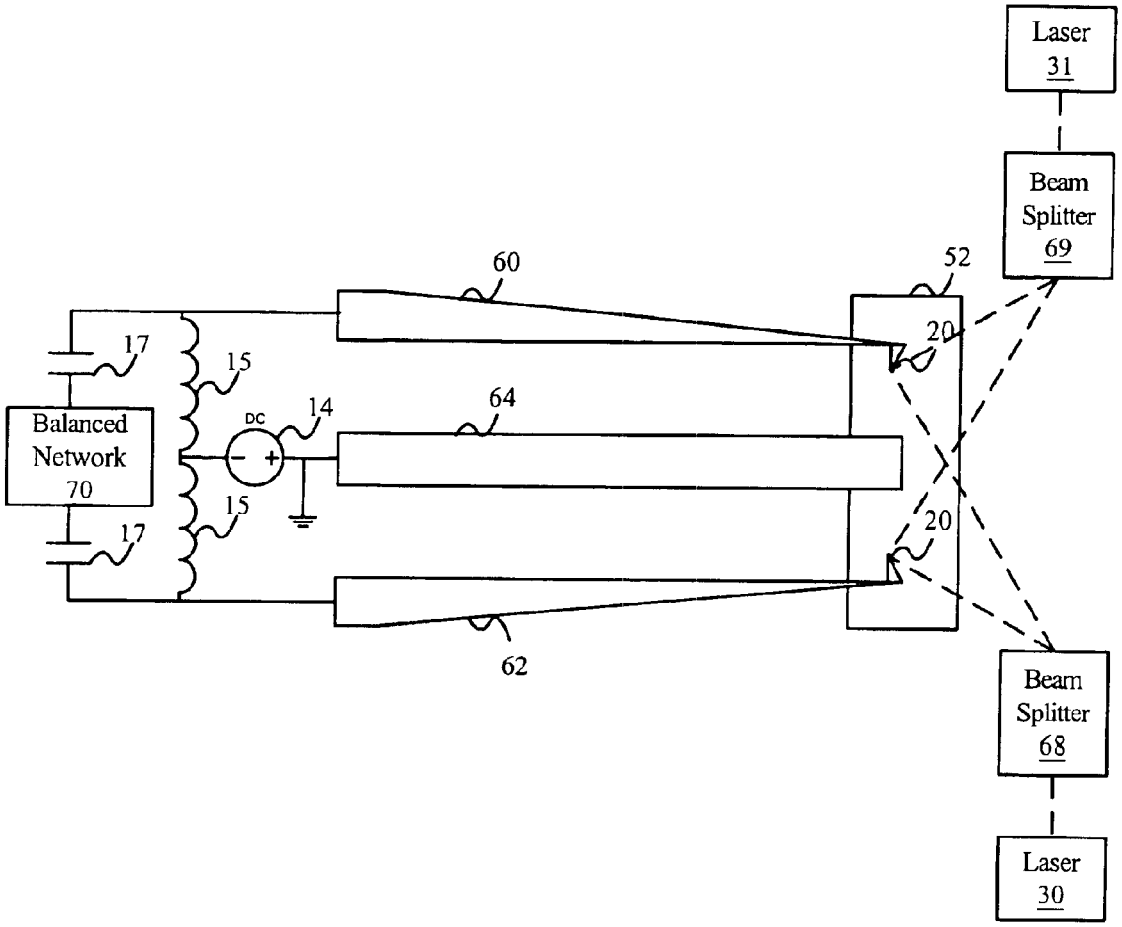
FIG. 6 is a diagram of a laser-assisted field emission microwave signal U) generator, including a balanced coplanar stripline and a tapered impedance matching circuit.

FIG. 6 is an alternate embodiment of a laser-assisted field emission microwave signal generator 10 that includes a coplanar line having two conducting strips 60, 62 that are negatively biased with respect to a strip 64 by the DC bias voltage source 14 through RF chokes 15. The conducting strips 60, 62 each have electron-emitting tips 20 that are sealed in an evacuated field emission tube 66 with a portion of the conducting strip 64. The electron-emitting tips 20 are irradiated with radiation that is divided by the beam splitter 68, which receives energy from the laser 30. Alternatively, a second laser 31 and a second beam splitter 69 may be added for photomixing and heterodyne receiving applications.

In operation, each of the conducting strips 60, 62 carries the field emission current. The conducting strips 60, 62 are tapered to match the beam impedance to the impedance of a balanced output network 70. The field emission current from conducting strips 60 and 62 is coupled to the balanced output network 70 through coupling capacitors 17.

Figure 7:
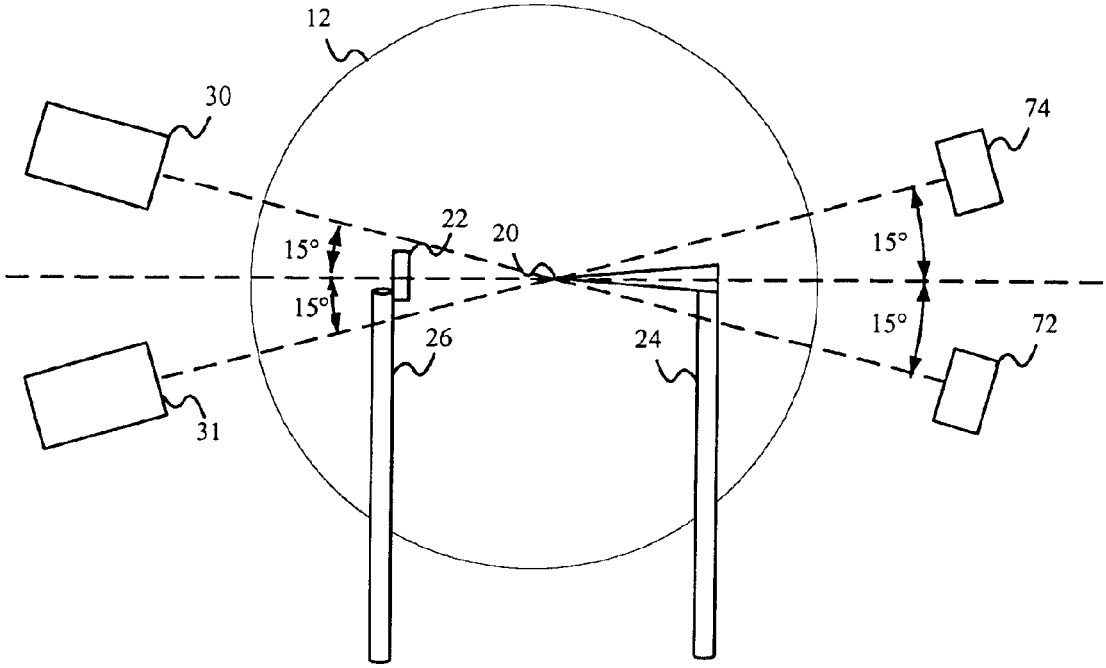
FIG. 7 is a diagram of a laser-assisted field emission system using mirrors to reflect the radiation energy for intracavity operation.

FIG. 7 illustrates a physical configuration that may be applied to any of the foregoing embodiments. Specifically, two lasers 30, 31 may be disposed at 15° angles to the axis of the electron-emitting tip 20, and mirrors 72, 74 may be disposed opposite the lasers 30, 31 to reflect the radiation that the lasers 30, 31 emit for intracavity operation. This configuration allows the electron-emitting tip 20 to be effectively irradiated multiple times, as the radiation passes the electron-emitting tip 20 on its way to the mirror 72, 74, and as the energy passes the electron-emitting tip 20 on its way from the mirror 72, 74. In this configuration, reflecting surfaces located at the backs of the lasers 30, 31 form open resonators with the mirrors 72, 74. In a preferred embodiment, the open resonators are formed such that the waist of the beam is located at the electron-emitting tip. This configuration provides the electron-emitting tip 20 with significantly more radiation than a system not utilizing intracavity operation.

In any of the forgoing embodiments, the electron-emitting tip 20 may be fabricated from various materials such as tungsten, molybdenum, iridium, titanium, zirconium, hafnium, aluminum nitride, gallium nitride, diamond-like carbon, molybdenum silicide, and refractory metal carbides such as zirconium carbide or hafnium carbide. These materials may be used either singly or combined as coatings on the electron-emitting tips. The electron-emitting tip 20 may include features such as micro-protrusions, macro-outgrowths, or super tips. These features may be created using well-known heating techniques, electron deposition, or other techniques known to those skilled in the art. The purpose of these features is to roughen the electron-emitting tip 20 to intensify the local electric field, and thus increase the static current density by as much as 20 dB.

Of course, it should be understood that a range of changes and modifications could be made to the preferred embodiments described above. For example, the impedance tapering shown in FIGS. 4–6 could follow exponential, Gaussian, Dolph-Chebychev or Klopfenstein tapers to optimize the usable bandwidth of the taper. Metals such as silver, aluminum or gallium may be added to the electron-emitting tip to enhance the local optical field through the use of surface plasmons. It is therefore intended that the foregoing detailed description be regarded as illustrative rather than limiting and that it be understood that it is the following claims, including all equivalents, which are intended to define the scope of this invention.

The present invention generates a microwave signal from a laser-assisted field emission capable of connecting to external devices. The invention enables an electron current from a high-impedance source electrode to couple with a lower impedance connector. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An optoelectronic device comprising:

an evacuated chamber;

a negatively-biased source electrode disposed within the evacuated chamber and having a source lead extending outside the evacuated chamber;

a collector electrode disposed within the evacuated chamber and having a collector lead extending outside the evacuated chamber, wherein there is a first impedance between the source lead and the collector lead;

a laser generator adapted to emit radiation that is focused on the source electrode to stimulate emission of rapidly varying electrical current from the source electrode;

an impedance matching device coupled to the source lead and the collector lead or incorporated in them; and a connector coupled to the impedance matching device, the connector adapted to couple to a second impedance, wherein the impedance matching device is adapted to match the first impedance to the second impedance.

2. The device of claim 1, wherein the impedance matching device causes a narrow-band impedance match by having a series reactance and a parallel susceptance.

3. The device of claim 2, wherein the series reactance comprises inductive or capacitive components.

4. The device of claim 3, wherein the series reactance has a value approximately equivalent to the square root of the product of the first impedance and the second impedance.

5. The device of claim 2, wherein the parallel susceptance comprises inductive or capacitive components.

6. The device of claim 5, wherein the parallel susceptance has a value approximately equivalent to the reciprocal of the square root of the product of the first impedance and the second impedance.

7. The device of claim 6, wherein the first impedance is approximately 100,000,000 Ohms.

8. The device of claim 7, wherein the second impedance is approximately 50 Ohms.

9. The device of claim 1, wherein the impedance matching device comprises a wide-band impedance match having an autotransformer coupled to the source lead and a coupling capacitor coupled to the autotransformer and coupled to the connector.

10. The device of claim 9, wherein the autotransformer has a ferrite core.

11. The device of claim 1, wherein the impedance matching device comprises a wide-band impedance match comprising:

a center conductor having a first end and a second end and having a diameter that tapers to a point at a first end, wherein the point forms the source electrode having the first impedance, and wherein the center conductor has a second diameter at the second end that is coupled to the connector that is adapted to couple to the second impedance; and a substantially cylindrical outer conductor disposed around the center conductor in a coaxial fashion, the outer conductor having a radius smaller than a wavelength of the rapidly varying electrical current from the source electrode.

12. The device of claim 1, wherein the impedance matching device comprises a wide-band impedance match comprising:

a first stripline having a first end and a second end, the first stripline having a width that tapers to a point at the first end, wherein the point forms the source electrode having the first impedance, and wherein the first stripline has a second width at the second end that is coupled to the connector that is adapted to couple to the second impedance; and a second stripline having a third end and a fourth end, the second stripline having a width that tapers to a point at the third end and having a fourth width at the fourth end.

13. For use with an optoelectronic device comprising an evacuated chamber having a negatively-biased source electrode and a collector electrode disposed therein, wherein the source and collector electrodes have a first impedance, a laser generator adapted to emit radiation that is focused on the source electrode to stimulate emission of a rapidly varying electrical current from the source electrode, and a connector adapted to couple to a second impedance, an impedance match adapted to match the first impedance to the second impedance, comprising:

a center conductor having a first end and a second end and having a diameter that tapers to a point at the first end, wherein the point forms the source electrode having the first impedance, and wherein the center conductor has a second diameter at the second end that is coupled to the connector that is adapted to couple to the second impedance; and a substantially-cylindrical outer conductor forming the collector electrode, the outer conductor being disposed around the center conductor in a coaxial fashion, the outer conductor having a radius smaller than a wavelength of the rapidly varying electrical current from the source electrode.

14. The impedance matching device of claim 13, wherein the first impedance is approximately 100,000,000 Ohms.

15. The impedance matching device of claim 14, wherein the second impedance is approximately 50 Ohms.

16. The impedance matching device of claim 12, wherein the center conductor tapers linearly from the point at the first end to the second diameter at the second end.

17. The impedance matching device of claim 13, wherein the center conductor tapers exponentially from the point at the first end to the second diameter at the second end.

18. The impedance matching device of claim 15, wherein the center conductor tapers according to a Gaussian taper from the point at the first end to the second diameter at the second end.

19. The impedance matching device of claim 15, wherein the center conductor tapers according to a Dolph-Chebychev taper from the point at the first end to the second diameter at the second end.

20. The impedance matching device of claim 15, wherein the center conductor tapers according to a Klopfenstein taper from the point at the first end to the second diameter at the second end.

21. For use with an optoelectronic device comprising an evacuated chamber having a negatively-biased source electrode and a collector electrode disposed therein, wherein the source and collector electrodes have a first impedance, a laser generator adapted to emit radiation that is focused on the source electrode to stimulate emission of a rapidly varying electrical current from the source electrode, and a connector adapted to couple to a second impedance, an impedance matching device adapted to match the first impedance to the second impedance, comprising:

a first stripline having a first end and a second end, the first stripline having a width that tapers to a point at the first end, wherein the point forms the source electrode having the first impedance, and wherein the first stripline has a second width at the second end that is coupled to the connector that is adapted to couple to the second impedance; and a second stripline forming the collector electrode, the second stripline having a third end and a fourth end, the second stripline having a third width that tapers to a point at the third end and having a fourth width at the fourth end.

22. The impedance matching device of claim 21, wherein the first impedance is approximately 100,000,000 Ohms.

23. The impedance matching device of claim 22, wherein the second impedance is approximately 50 Ohms.

24. The impedance matching device of claim 21, wherein the first stripline tapers linearly from the point at the first end to the second width at the second end.

25. The impedance matching device of claim 21, wherein the first stripline tapers exponentially from the point at the first end to the second width at the second end.

26. The impedance matching device of claim 21, wherein the first stripline tapers according to a Gaussian taper from the point at the first end to the second width at the second end.

27. The impedance matching device of claim 21, wherein the first stripline tapers-according to a Dolph-Chebychev taper from the point at the first end to the second width at the second end.

28. The impedance matching device of claim 21, wherein the first stripline tapers according to a Klopfenstein taper from the point at the first end to the second width at the second end.

29. For use with an optoelectronic device comprising an evacuated chamber having a first negatively-biased source electrode, a second negatively-biased source electrode and a collector electrode disposed therein, wherein the source and collector electrodes have a first impedance, a laser generator adapted to emit radiation that is focused on the source electrode to stimulate emission of rapidly varying electrical current from the first and second source electrodes, and a connector adapted to couple to a second impedance, an impedance matching device adapted to match the first impedance to the second impedance, comprising:

a first stripline having a first end and a second end, the first stripline having a width that tapers to a first point at the first end, wherein the first point forms the first source electrode having the first impedance, and wherein the first stripline has a second width at the second end that is coupled to the connector that is adapted to couple to the second impedance;

a second stripline having a third end and a fourth end, the second stripline having a third width that tapers to a second point at the third end, wherein the second point forms the second source electrode having the first impedance, and wherein the second stripline has a fourth width at the fourth end that is coupled to the connector that is adapted to couple to the second impedance; and a third stripline having a fifth end and a sixth end forming the collector electrode.

30. The impedance matching device of claim 29, wherein the first impedance is approximately 100,000,000 Ohms.

31. The impedance matching device of claim 29, wherein the second impedance is approximately 50 Ohms.

32. The impedance matching device of claim 29, wherein the first and second striplines taper linearly from the first and second points to the second and fourth widths at the second and fourth ends.

33. The impedance matching device of claim 29, wherein the first and second striplines taper exponentially from the first and second points to the second and fourth widths at the second and fourth ends.

34. The impedance matching device of claim 29, wherein the first and second striplines taper according to a Gaussian taper from the first and second points to the second and fourth widths at the second and fourth ends.

35. The impedance matching device of claim 29, wherein the first and second striplines taper according to a Dolph-Chebychev taper from the first and second points to the second and fourth widths at the second ends.

36. The impedance matching device of claim 29, wherein the first and second striplines taper according to a Klopfenstein taper from the first and second points to the second and fourth width at the second and fourth ends.

* * * * *